US005718296A

United States Patent [19]

Chen

[11] Patent Number: 5,718,296

[45] Date of Patent: Feb. 17, 1998

[54] STORING ENERGY TYPE OF IMPACT CONTROL MECHANISM FOR PNEUMATIC WRENCH

[76] Inventor: Lijun Chen, Room 503, 7, Lane 77, Kangjian Road, Shanghai 200233, China

[21] Appl. No.: 702,600

[22] PCT Filed: Jan. 2, 1996

[86] PCT No.: PCT/CN96/00002

§ 371 Date: Aug. 29, 1996

§ 102(e) Date: Aug. 29, 1996

[87] PCT Pub. No.: WO96/20814

PCT Pub. Date: Jul. 11, 1996

[30] Foreign Application Priority Data

Dec. 30, 1994 [CN] China ..... 94236264.0

[51] Int. Cl.[6] ..... B25B 21/02

[52] U.S. Cl. ..... 173/17; 173/128; 173/206

[58] Field of Search ..... 173/206, 207, 173/208, 17, 128, 177, 179

[56] References Cited

U.S. PATENT DOCUMENTS

| | | | |
|---|---|---|---|
| 1,709,440 | 4/1929 | Osgood | 173/179 |
| 2,661,204 | 12/1953 | Gregoire | 267/16 |
| 3,228,486 | 1/1966 | Kaman et al. | 173/93.6 |
| 3,904,305 | 9/1975 | Boyd | 173/179 |
| 4,291,771 | 9/1981 | Perraud | 173/179 |
| 4,899,836 | 2/1990 | Venot | 173/207 |
| 5,117,921 | 6/1992 | Bartels et al. | 173/206 |

FOREIGN PATENT DOCUMENTS

2095743 U 7/1991 China .

*Primary Examiner*—Scott A. Smith

*Attorney, Agent, or Firm*—Merchant, Gould, Smith, Edell, Welter & Schmidt

[57] ABSTRACT

A kind storing energy type of impact control mechanism for pneumatic wrench comprises a flying hammer and a centrifugal valve fitted in the flying hammer, a timing mechanism, a spring, a retaining ring, a limiting device composed of a limiting key-slot on the centrifugal valve and a limiting plunger head with one end sticking into the centrifugal valve chamber and an impact pin. Besides, there are a stretching air duct to make the impact pin stretch and a transition air duct, and a retracting air duct to make the impact pin retract. And on the outer periphery of the centrifugal valve there are a concentric annular slot and an eccentric slot communicating with each other, and another concentric annular spaced apart from them. The above-mentioned structure can raise the controlled air pressure in pneumatic wrench, lower machining difficulty and reduce flying hammer height.

4 Claims, 6 Drawing Sheets

STORING ENERGY TYPE OF IMPACT CONTROL MECHANISM FOR PNEUMATIC WRENCH

TECHNICAL FIELD

The present invention relates to a storing energy type of impact control mechanism for pneumatic wrench.

BACKGROUND ART

The pneumatic wrench is an efficient tool for mounting and dismounting bolt and nut with compressed air as power. During operation, the compressed air drives blades to rotate the rotor and then a flying hammer (inertial weight) is driven which, after being rotated to a certain speed, will push out an impact pin to drive the wrench shaft and associated sleeve pieces of various specifications to tighten up or loosen bolt and nut. Usually a centrifugal valve is fitted in the flying hammer which centrifugal valve slides through the centrifugal force produced by the rotating flying hammer, thereby realizing a function of change direction of air ducts, i.e. realizing a reciprocation motion of making the impact pin stretch out of the flying hammer or retract back to the flying hammer. The impact pin, when stretching out, drives a wrench shaft to impact bolt or nut, and the wrench is at a waiting state when the impact pin retracts back.

In the prior art, the structure and its air duct changing function of a centrifugal valve 113 are shown in FIG. 1 and FIG. 2. Therein, the numeral 108 denotes a flying hammer, 100 denotes the rotating axis of the flying hammer, 114 denotes a shallower concentric annular slot on the outer periphery of the centrifugal valve 113, 128 denotes a wall-bridging limiting slot at one end of the centrifugal valve 113, 116 denotes a wall-bridging limiting rod fitted in the flying hammer 108, for use in match with the wall-bridging limiting slot 128 at one end of the centrifugal valve 113, 103 and 131 denote respectively a timing pin located in the centrifugal valve 113 and a spring to push out the timing pin, 102 denotes a plunger located in the flying hammer 108 and able to push the timing pin 103, 132 denotes a retaining ring embedded on the wall of the centrifugal valve chamber 119, and **10*a* and 11 denote respectively a compressed air inlet duct and a stretching air duct located in the flying hammer 108. FIG. 1 shows the state when the flying hammer 108 is in a waiting mode, the centrifugal valve 113 under the pulling force P of the spring is located in the centrifugal valve chamber 119 of the flying hammer 108. At this moment, one end of the centrifugal valve 113 presses tightly against the retaining ring 132, while the air duct 10*a* is not in communication with air duct 11, so that compressed air can not enter the stretching air duct inlet 9 (In FIG. 6, it is in communication with air duct 11, which is to be described in detail below) to push out an impact pin 1, and can only enter a retracting air duct inlet 5 through other air ducts (to be discussed in detail below) to enter further an impact pin chamber 18 and to make the impact pin 1 retract to a state as shown in FIG. 6. FIG. 2 shows that when the flying hammer rotates and the plunger 102 pushes the timing pin 103 into the centrifugal valve 113, the centrifugal valve 113 under the centrifugal force overcomes the spring force and is located in the centrifugal valve chamber 119 of the flying hammer 108. At this moment, the bottom end of the wall-bridging limiting slot 128 at one end of the centrifugal valve 113 presses tightly against the wall-bridging rod 116, and the air duct 10*a* is in communication with the concentric annular slot 114 on the outer periphery of the centrifugal valve 113, so that compressed air through the stretching air duct inlet 9 in communication with the stretching air duct 11 enters the impact pin chamber 18 (See FIG. 7) to push out the impact pin 1; while the residual air originally left in the impact pin chamber 18 discharges through the retracting air duct inlet 5** (to be described in detail below).

The following drawbacks exist in the above-mentioned structure: (1) Due to mutual constraint of the structure, the concentric annular slot 114 on the outer periphery of the centrifugal valve 113 is very shallow, usually only 0.5 mm in depth, so that when as a passage to join air ducts **10*a* and 11 (See FIG. 2), it, due to its narrowness, will restrict the volume of compressed air entering the impact pin chamber 18, so as to weaken the force to push the impact pin 1; (2) due to a necessity for the centrifugal valve 113 to have a function to seal the concentric annular slot 114 and to make compressed air inside it not leak outside, hence the clearance between the centrifugal valve 113 and the wall of centrifugal valve chamber 119 is very small. Under such a condition, in order to ensure the centrifugal valve 113 to return to a position as shown in FIG. 1, and the timing pin 103 can enter the hole where the plunger 102 lies smoothly, it is necessary to have a high symmetry between the wall-bridging limiting slot 128 and the hole where the wall-bridging limiting rod 116 lies, which will necessarily increase the machining difficulty. In case of any error, the flexibility of the centrifugal valve 113 to slide in the centrifugal valve chamber 119** will be affected, making the pneumatic wrench work unsuitably or fail to work.

Refer to FIGS. 3–5 which show the internal structure of the flying hammer 108 of the prior art, wherein FIG. 3 is a sectional view of the flying hammer 108 with the same sectional position as that in FIG. 1, with the centrifugal valve 113, retaining ring 132, wall-bridging rod 116 and plunger 102 omitted; FIG. 4 is a sectional view along line A—A in FIG. 3 while FIG. 5 is a partial sectional view along B direction in FIG. 4. Please refer to FIG. 1 simultaneously, when the centrifugal valve 113 is in a position as shown in FIG. 1, the air flow in the compressed air inlet 10 can not pass through the air duct **10*a* to air duct 11, but through air duct 4*a*, and by butting open or pushing up open a check valve 30 it enters an air duct 23 and then successively enters air duct 21 (See FIG. 3), air duct 24 (See FIG. 5) and retracting air duct inlet 5 (See FIG. 6), so as to push the impact pin 1 to retreat; and the residual air in the upper potion of the impact pin chamber 18 passes successively through the stretching air duct inlet 9 (See FIG. 6 and FIG. 5), air duct 25 and air duct 11, then through the centrifugal valve chamber 119 on discharge (See FIG. 1). When the centrifugal valve 113 is in a position as shown in FIG. 2, the air flow in the compressed air inlet 10 passes through air duct 4*a* to enter air duct 10*a*, then through the concentric annular slot 114 on the centrifugal valve 113 to enter air duct 11 (See FIG. 2), and then successively to enter air duct 25 and the stretching air duct inlet 9, so as to push the impact pin 1 to stretch (See FIG. 7); and the residual air in the lower portion of the impact pin chamber 18 through the retracting air duct inlet 5 enters successively air duct 24, air duct 21 (See FIG. 5) and air duct 23. Due to the action of the check valve, the residual air can not circulate but to form air resistance. Besides, as shown in FIG. 4, there is still an auxiliary long hole 20 in the flying hammer 108, in order to facilitate the drilling out a small hole 120 of 0.5 mm diameter to communicate the compressed air inlet 10 with the impact pin chamber 18, so as to have a small amount of compressed air to enter the impact pin chamber 18 through the small hole 120 to facilitate the sliding of the impact pin 1. In FIG. 3 to FIG. 5, the numeral 133 denotes a hole for fitting the plunger 102, 117 denotes a hole for fitting a wrench shaft, 26 denotes a hole for fitting the wall-bridging limiting rod 116, and 22, 22***a*, 22*b*, 22*c*, 22*d*, 2*f*, and 22*m* denote respectively screw plugs to block one end of all air ducts. The above-mentioned structure has inherent problems as follows: (1) Due to the existence of check valve 30, when the impact pin 1 is stretching, the residual air in its lower chamber presents an air resistance which will affect the flexible sliding of the impact pin 1; (2) due to a crisscross distribution of air ducts inside the flying hammer 108 which is unable to be changed at will, the axial height of the flying hammer 108 is rather high.

DISCLOSURE OF INVENTION

One object of the present invention is to provide a kind of improved storing energy type of impact control mechanism which can raise the controlled air pressure inside the pneumatic wrench.

A further object of the present invention is to greatly lower the machining difficulty of the improved storing energy type of impact control mechanism.

A still further object of the present invention is to provide an storing energy type of impact control mechanism to eliminate air resistance, reduce number of air ducts in the flying hammer, so as to decrease the axial height of the flying hammer.

The object of the present invention are realized through the technical schemes in which storing energy type of impact control mechanism comprises a flying hammer, a centrifugal valve fitted in a centrifugal valve chamber in the flying hammer, an impact pin fitted in an impact pin chamber in the flying hammer, a plunger fitted in a plunger hole of the flying hammer, and a timing mechanism consisting of a timing pin fitted in the centrifugal valve chamber and a spring pushing the timing pin, a spring fitted in the centrifugal valve chamber and pulling the centrifugal valve, a retaining ring fitted on the centrifugal valve wall to restrict the centrifugal valve to move toward the interior of the centrifugal valve chamber, a limiting device consisting of a limiting member fitted on the flying hammer and a limiting structure located on the centrifugal valve to limit the centrifugal valve to move outward from the centrifugal valve chamber; air ducts located in the flying hammer, communicating compressed air inlet with a stretching air duct inlet on the impact pin chamber, to make compressed air push the impact pin to stretch; air ducts communicating with a retracting air duct inlet on the impact pin chamber to discharge the residual air in the impact pin chamber; air ducts located in the flying hammer, communicating compressed air inlet with retracting air duct inlet on the impact pin chamber, to make compressed air push the impact pin to retract; and air ducts communicating with stretching air duct inlet on the impact pin chamber to make residual air in the impact pin chamber discharge. Therein, on the outer periphery of said centrifugal valve there are an eccentric annular slot and a concentric annular slot communicating with each other, and another concentric annular slot spaced apart from said eccentric annular slot. The depth portion of said eccentric annular slot is adjacent to an incoming air duct communicating with compressed air inlet, and the shallow portion of the eccentric annular slot is adjacent to the plunger.

Another improvement of the present invention is, in said storing energy type of impact control mechanism, said limiting device to restrict the centrifugal valve to move outward from centrifugal valve chamber consists of a limiting member rigidly mounted on the flying hammer and formed by a limiting plunger head with one end sticking into the centrifugal valve chamber, and a limiting structure formed by a limiting key slot located on the centrifugal valve in sliding fit with the limiting plunger head and communicating with another concentric annular slot.

A further improvement of the present invention is, in said storing energy type of impact control mechanism.

Said air ducts located in the flying hammer, communicating compressed air inlet with stretching air duct inlet on the impact pin chamber to make compressed air push the impact pin to stretch consist of further an incoming air duct communicating with compressed air inlet, a stretching air duct with one end being able to communicate with the incoming air duct through the eccentric annular slot on the centrifugal valve, and a transition air duct with one end communicating with the stretching air duct inlet and another end communicating with the stretching air duct; and the air duct communicating with the retracting air duct inlet on the impact pin chamber to make the residual air in the impact pin chamber discharge consists of a retracting air duct with one end communicating with the retracting air duct inlet and another end communicating with the centrifugal valve chamber.

Said air duct located in the flying hammer, communicating compressed air inlet with retracting air duct inlet on the impact pin chamber to make compressed air push the impact pin to retract consists of a retracting air duct with one end being able to communicate with the incoming air duct through the concentric annular slot and eccentric annular slot on the centrifugal valve and another end to communicate with compressed air inlet; and the air duct communicating with the stretching air duct on the impact pin chamber to make the residual air in the impact pin chamber discharge consists of a stretching air duct with one end communicating with the stretching air duct inlet and another end being able to communicate with the centrifugal valve chamber through another concentric annular slot on the centrifugal valve.

The advantage of the present invention is, since an eccentric annular slot is provided on the centrifugal valve, the incoming air duct can be made to communicate with the stretching air duct through the depth portion on the slot, so as to flow in more compressed air and to raise the controlled air pressure inside the pneumatic wrench. Next, since the limiting plunger head and limiting key slot are used to replace the original wall-bridging limiting slot and wall-bridging rod, the machining difficulty is greatly lowered. Furthermore, since only fewer air ducts are used to replace the original check valve structure and a large number of air ducts in the flying hammer, not only will the air resistance be eliminated, the number of air ducts in the flying hammer decreased, the axial height of the flying hammer reduced, but also the machining difficulty will be further lowered.

A detailed description is made to an embodiment of the present invention with reference to the accompanying drawings as follows, so as to understand more clearly the conception and advantage of the present invention.

PREFER EMBODIMENTS OF INVENTION

The structure shown in FIG. 1 to FIG. 5 has been described in detail hereinabove and the description thereof is omitted here.

Figure 1:
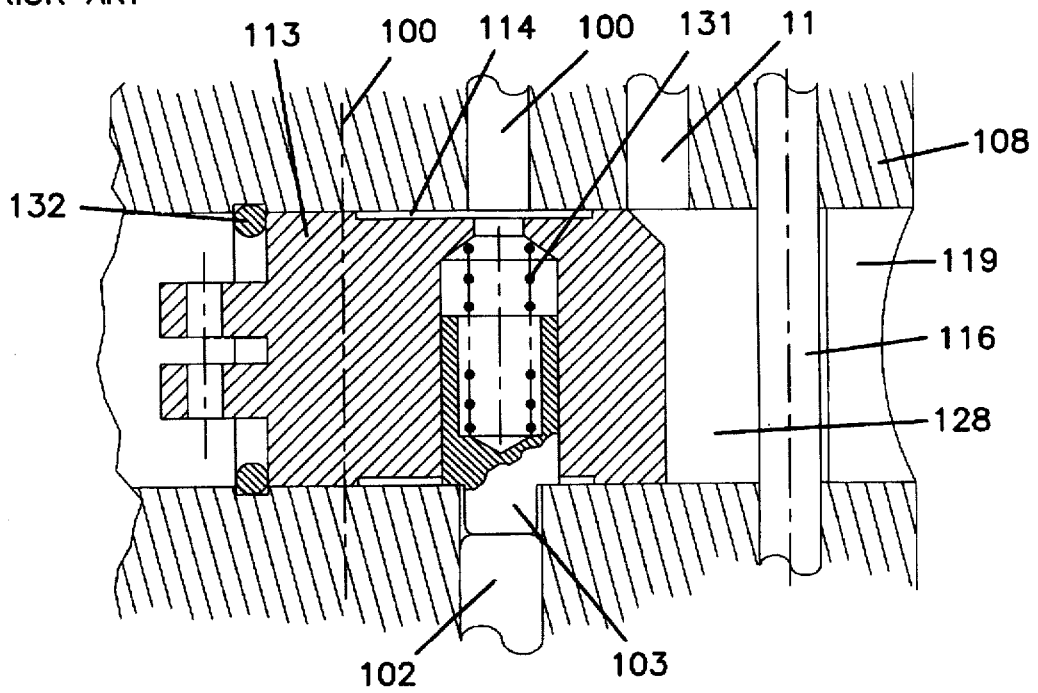
FIG. 1 PRIOR ART
FIG. 1 is a sectional view of the centrifugal valve structure and its retracting state in the flying hammer of the prior art.
Figure 2:
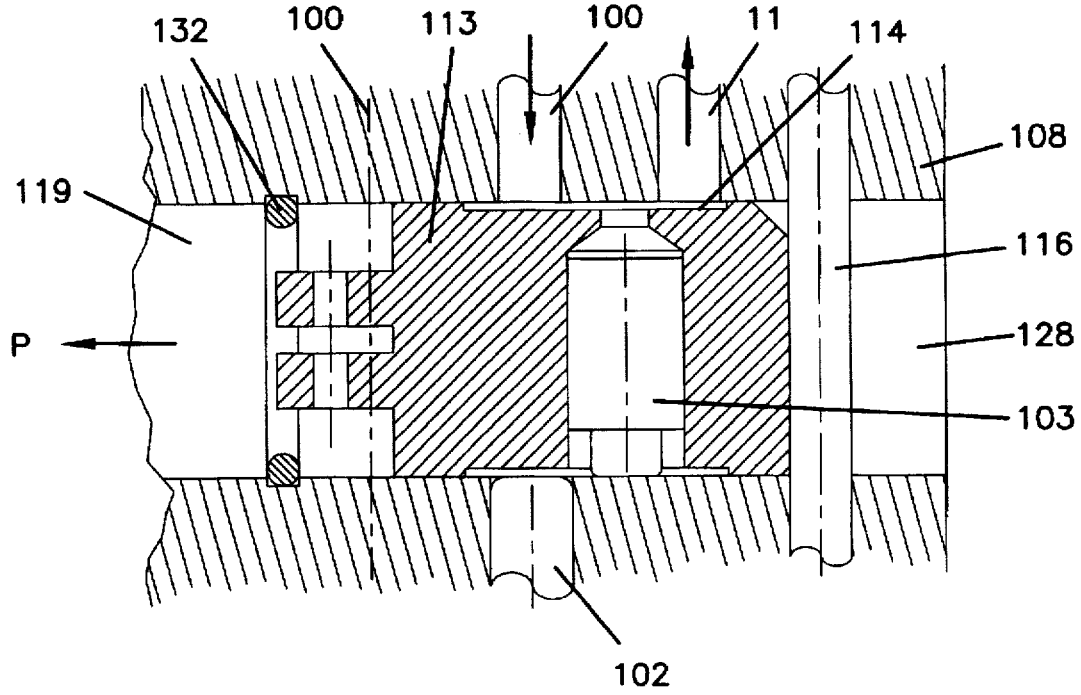
FIG. 2 PRIOR ART
FIG. 2 is a sectional view of the centrifugal valve in a thrown out state in the flying hammer of the prior art.
Figure 3:
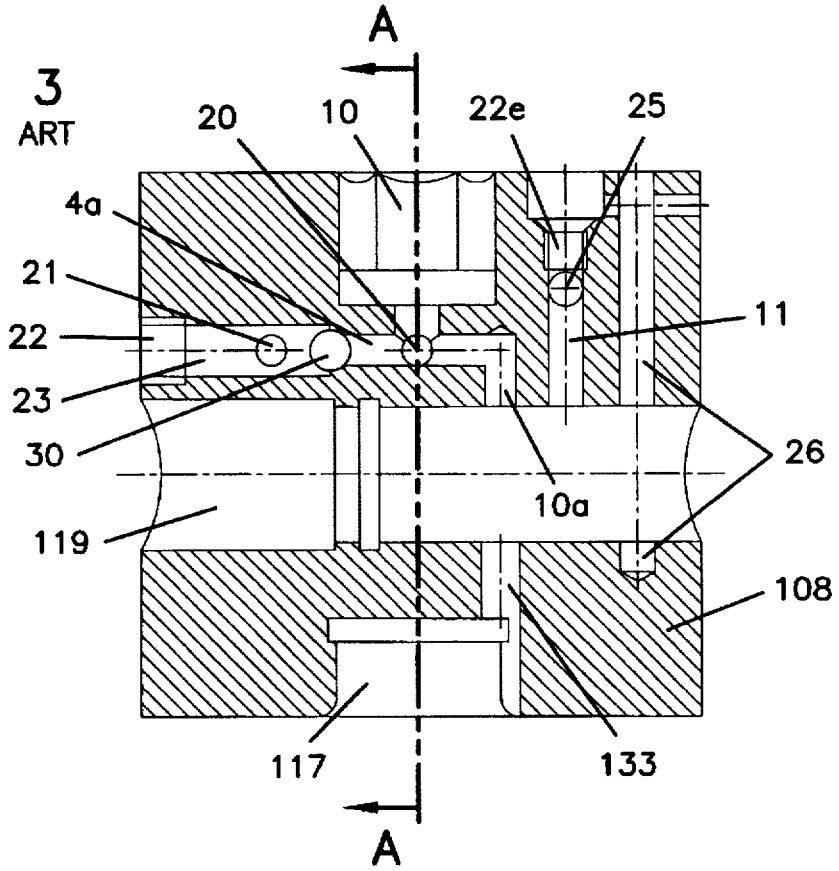
FIG. 3 PRIOR ART
FIG. 3 is a sectional view of the flying hammer of the prior art, corresponding to the sectional view position of the flying hammer in FIG. 1.
Figure 4:
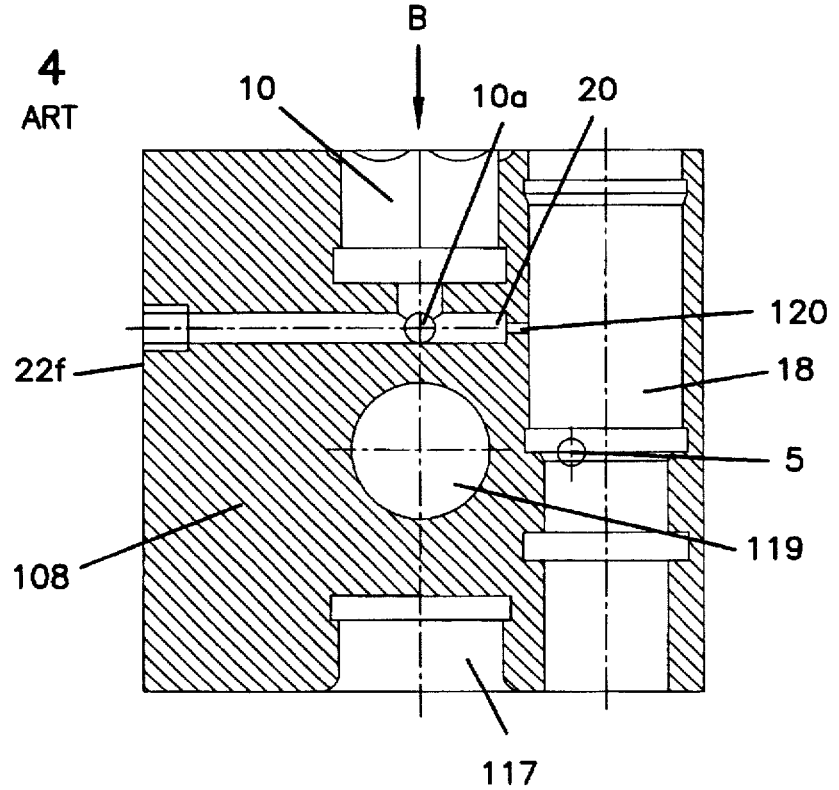
FIG. 4 PRIOR ART
FIG. 4 is a sectional view along line A—A in FIG. 3.
Figure 5:
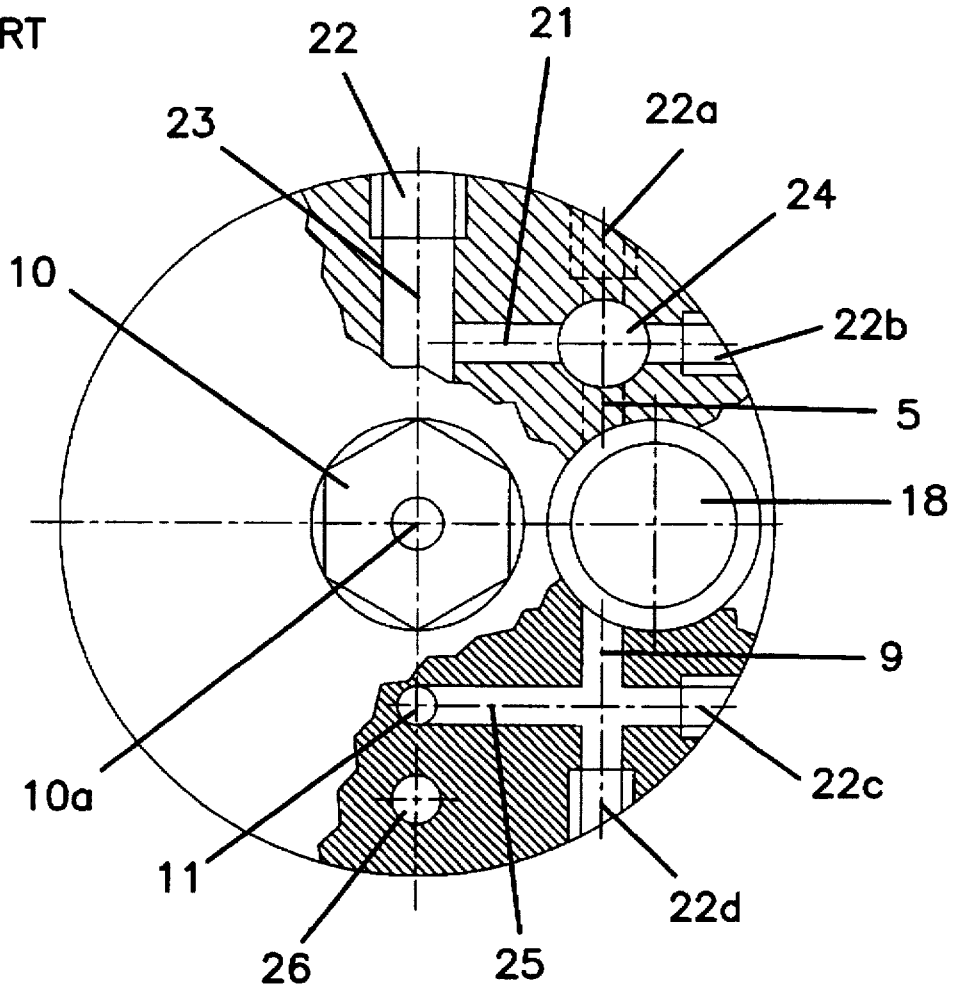
FIG. 5 PRIOR ART
FIG. 5 is a partial sectional view along direction B in FIG. 4.
Figure 6:
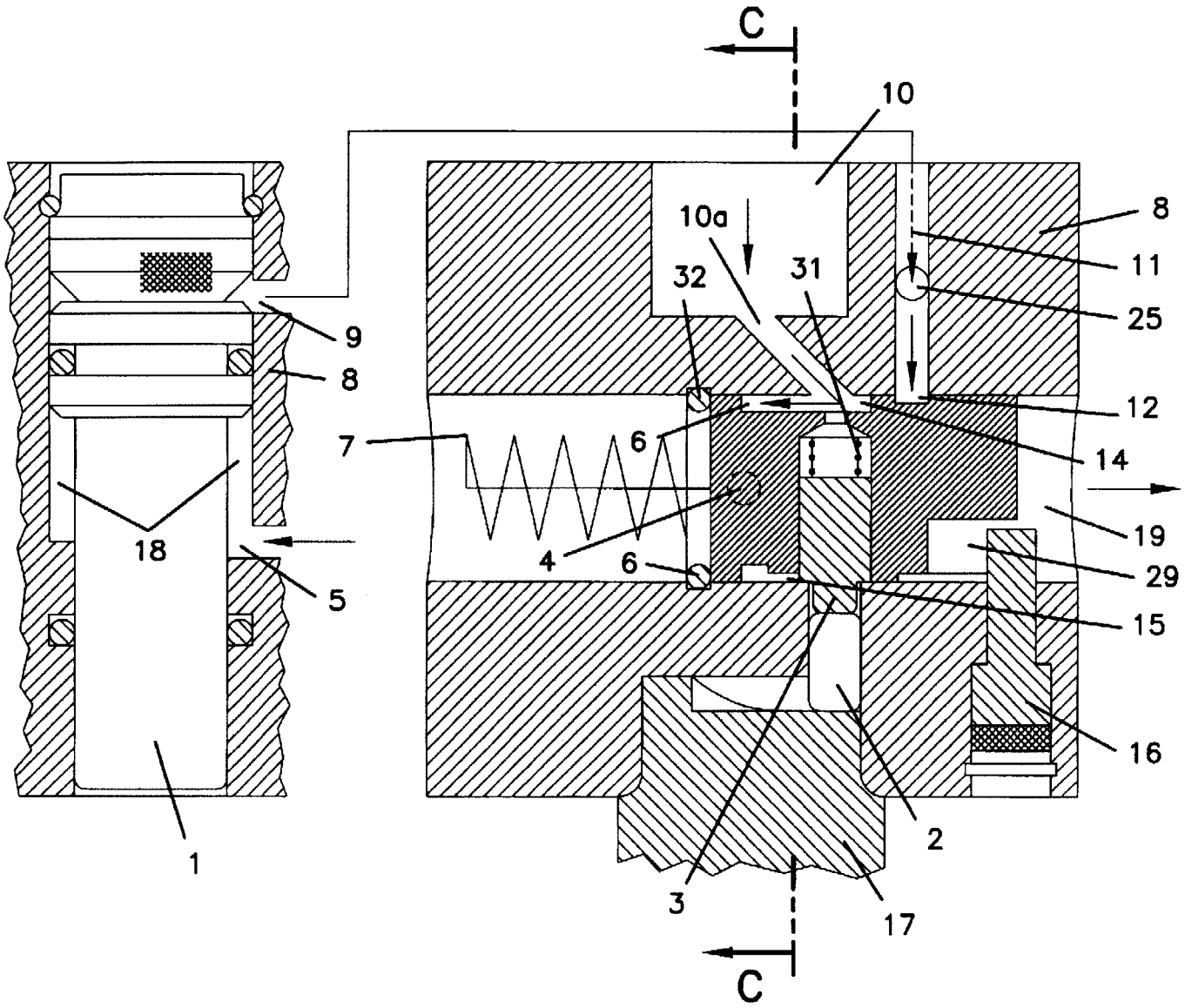
FIG. 6 is a sectional schematic view of an embodiment of the present invention, wherein the centrifugal valve in a retracted state.
Figure 7:
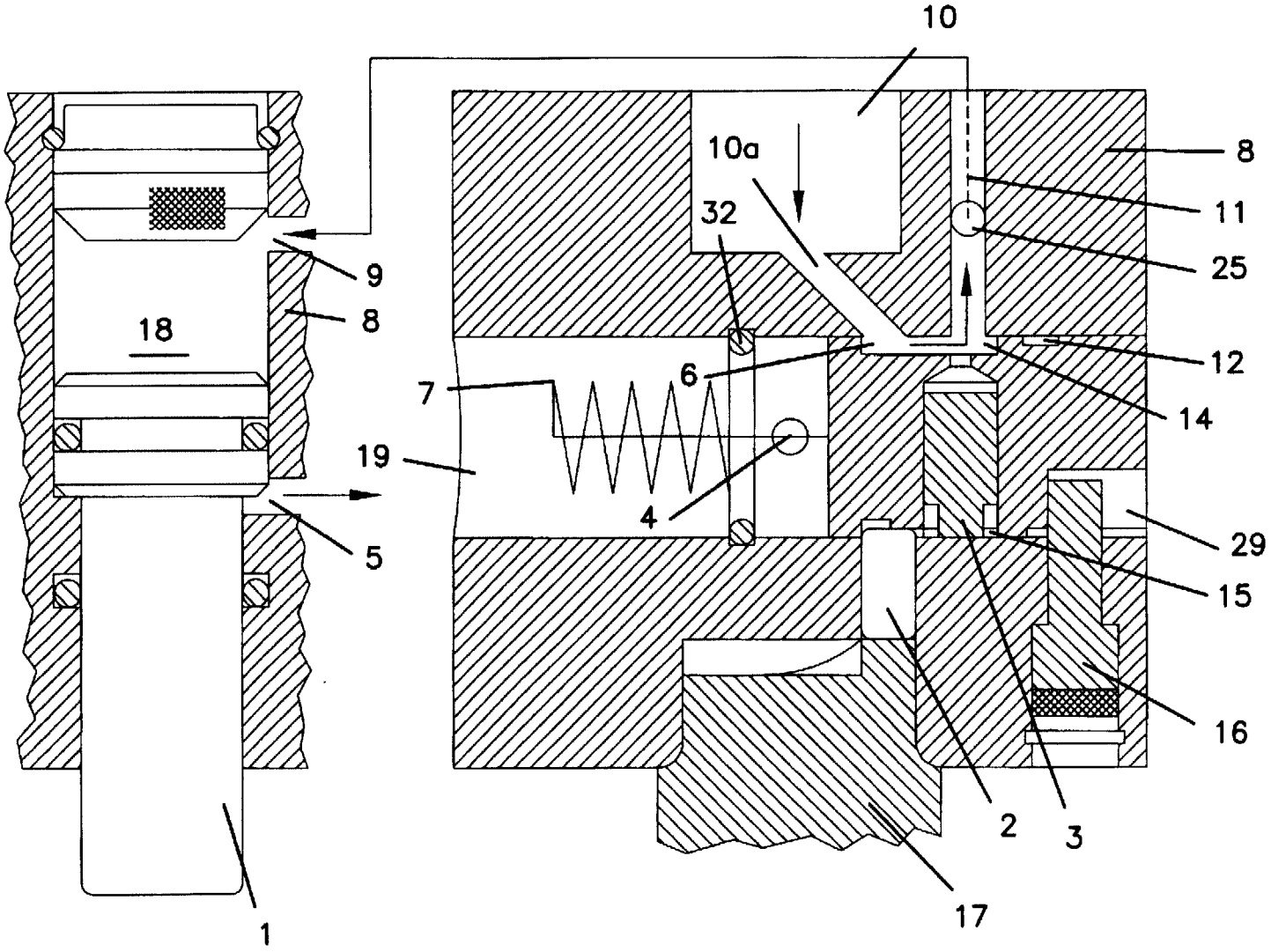
FIG. 7 is a sectional schematic view of the centrifugal valve in structure shown in FIG. 6 in a thrown out state.

Referring to FIGS. 6 and 7, the storing energy type of impact control mechanism provided by the present embodiment is composed in the following mode: There is a centrifugal valve chamber 19 inside a flying hammer 9, in which a centrifugal valve 13 is set up in sliding fit. On the outer periphery of said centrifugal valve 13 there are an inner communicated concentric annular slot 6 and an eccentric annular slot (14,15), wherein the numeral 14 denotes a depth portion of the eccentric annular slot while the numeral 15 denotes a shallow portion of said eccentric annular slot. Besides, on the outer periphery of the centrifugal valve 13 there is also another concentric annular slot 12 spaced apart from the eccentric annular slot (14, 15), and at one end of the centrifugal valve 13 is a limiting key slot 29, and said limiting key slot 29 is communicated with another concentric annular slot 12. Inside said centrifugal valve 13 are fitted a timing pin 3 and a spring 31 pushing the timing pin 3 which constitute a timing mechanism together with a plunger 2 fitted in the flying hammer 8. One end of a spring 7 is fixed in the centrifugal valve chamber 19, and another end is connected with one end of the centrifugal valve 13 to pull the centrifugal valve 13 inward (i.e. leftward in FIGS. 1 and 2). A retaining ring 32 is set up on the wall of the centrifugal valve 19 to limit the centrifugal valve to move inward to the centrifugal valve chamber 19. While a limiting plunger head 16 fixed on the flying hammer 8 with one end sticking into the centrifugal valve chamber 19 can be in sliding fit with the limiting key slot 29 on the centrifugal valve 13, so as to limit the centrifugal valve 13 to move outward (i.e. rightward as shown in FIGS. 1 and 2) from the centrifugal valve chamber 19. Through relative rotation of a wrench shaft 17 and the flying hammer 8, the plunger 2 and then the timing pin 3 can be pushed up to enable the centrifugal valve 13 to slide in the centrifugal valve chamber 19. In the flying hammer 8 there is also an impact pin chamber 18 in which is set up an impact pin 1 in sliding fit (Their original positions are at the side of the centrifugal valve chamber 19 and at a 90 degree angle with each other, for the purpose of convenient narration, they are illustrated at one side after being moved).

Figure 8:
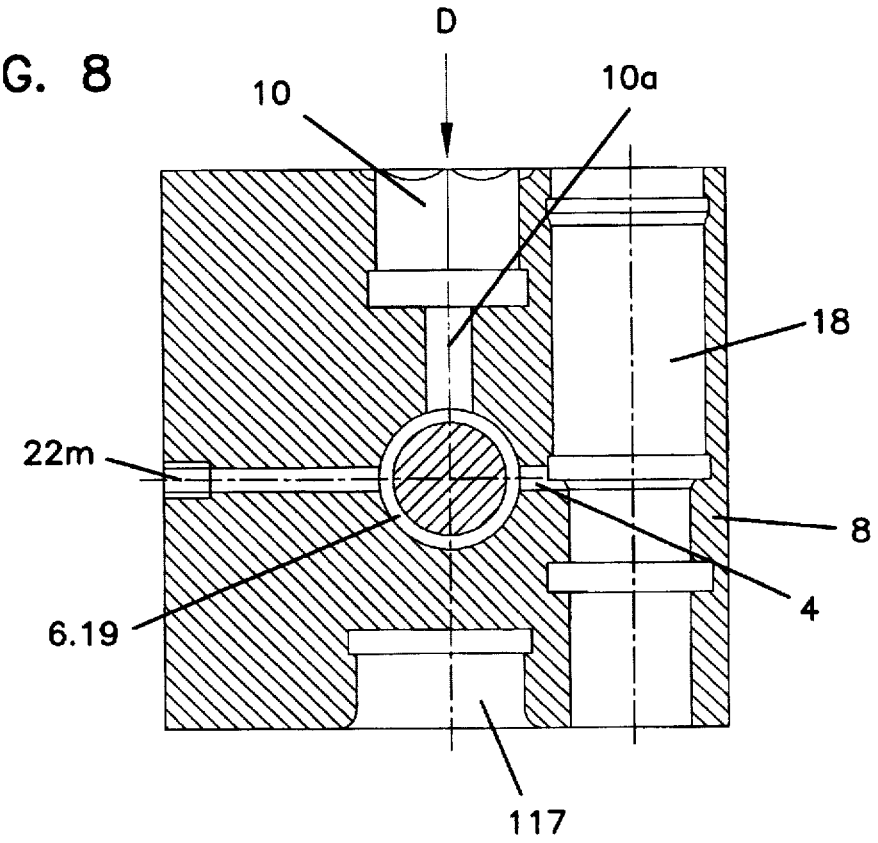
FIG. 8 is a sectional view along line C—C in FIG. 6.
Figure 9:
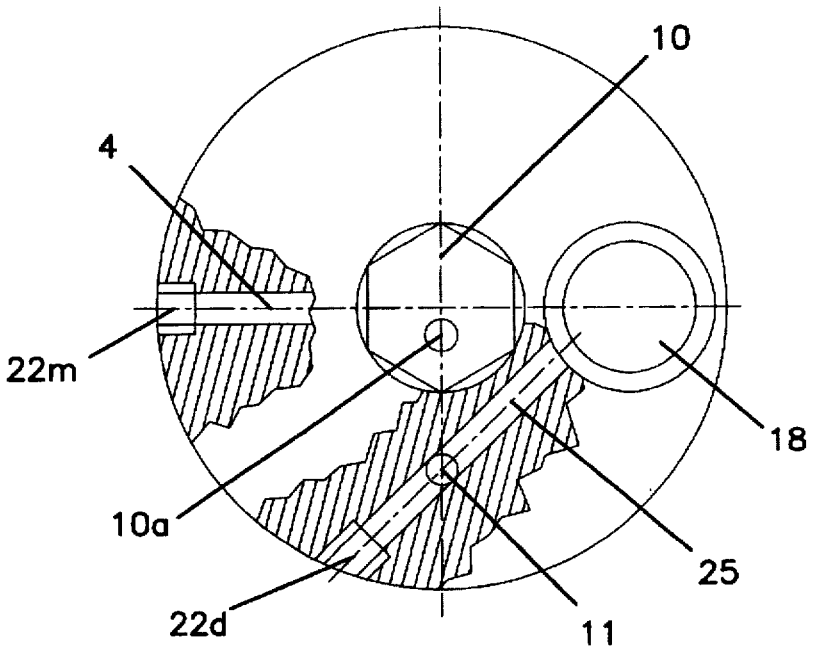
FIG. 9 is a partial sectional view along direction D in FIG. 8.

Referring meanwhile to FIGS. 8 and 9, air ducts in the flying hammer 8 comprise a compressed air inlet 10 communicating with the compressed air source, an incoming air duct 1*a* with one end communicating with the compressed air inlet 10 and another end communicating with the centrifugal valve chamber 19, a stretching air duct 11 with one end communicating with the centrifugal valve chamber 19, and a transition air duct 25 with one end communicating with the stretching air duct 11 and another end communicating with the stretching air duct inlet 9. Besides, air ducts inside the flying hammer 8 comprise also a retracting air duct 4 with one end communicating with centrifugal valve chamber 19 and anther end communicating with a retracting air duct inlet 5. During setting up the centrifugal valve 13 in the centrifugal valve chamber 19, the depth portion 14 of the eccentric annular slot on the centrifugal valve 13 is adjacent to the incoming air duct 10*a*, while its shallow portion is adjacent to the plunger 2.

The working principle of the present invention is, when the flying hammer 8 is at a waiting state, the centrifugal valve 13 is located in a position as shown in FIG. 6 under pull of the spring 7 and the restricting of the retaining ring 32. At this moment through the compressed air inlet 10, compressed air enters into air duct 10*a*, the depth portion 14 of eccentric annular slot on the centrifugal valve 13 and the concentric annular slot 6, the retracting air duct 4, and finally through the retracting air duct inlet 5 enters into the impact pin chamber 18 to push the impact pin 1 to retract to a position as shown in FIG. 6. And the residual air originally in the upper portion of the impact pin chamber 18 then through the stretching air duct inlet 9, transition air duct 25, stretching air duct 11, another concentric annular slot 12 and the limiting key slot 29 on the centrifugal valve 13 and finally discharges through the centrifugal valve chamber 19. When the flying hammer 8 is in a rotating state, the wrench shaft 17 will push up the plunger 2, and then the timing pin 3 to locate the timing pin 3 in the centrifugal valve 13, while the centrifugal valve 13 under the action of centrifugal force will overcome the pull of spring 7 to move outward, but the centrifugal valve will be located in a position as shown in FIG. 7, due to the restricting action of the limiting plunger head. At this moment, the centrifugal valve 13 no longer seals up the open end of the retracting air duct 4 while compressed air through the compressed air inlet 10 enters into the incoming air duct 10*a*, the depth portion 14 of eccentric annular slot on the centrifugal valve 13, the stretching air duct 11, and finally through the stretching air duct inlet 9 enters into the impact pin chamber 18 to push the impact pin 1 to stick out to a position as shown in FIG. 7. And the residual air originally in the impact pin chamber 18 then through the retracting air duct inlet 5, retracting air duct 4, and finally enters into the centrifugal valve chamber 19 to be discharged.

All the similar numerals in the accompanying drawings denote the similar structures and components.

I claim:

1. A kind of storing energy type of impact control mechanism comprises a flying hammer (8), a centrifugal valve (13) fitted in a centrifugal valve chamber (19) of the flying hammer (8), an impact pin (1) fitted in an impact pin chamber (18) of the flying hammer (8), a timing mechanism composed of a plunger (2) fitted in a plunger hole (133) of the flying hammer (8) and a timing pin (3) and a spring (31) pressing the timing pin (3) fitted in the centrifugal valve (13), a spring (7) fitted in the centrifugal valve chamber (19) and pulling up the centrifugal valve (13), a retaining ring (32) fitted on the centrifugal valve chamber (19) wall to limit the centrifugal valve (13) to move inward to the centrifugal valve chamber (19), a limiting device composed of a limiting member fitted on the flying hammer (8) and a limiting structure located on the centrifugal valve (13) to limit the centrifugal valve (13) to move outward from the centrifugal valve chamber (19), air ducts located in the flying hammer (8) communicating the compressed air inlet (10) with a stretching air duct inlet (9) on the impact pin chamber (18) to make compressed air to push the impact pin (1) to stretch, air ducts communicating with the retracting air duct (5) on the impact pin chamber (18) to discharge residual air in the impact pin chamber (18) to discharge residual air in the impact pin chamber (18), air ducts located in the flying hammer (8) communicating compressed air inlet (10) with the retracting air duct (5) on the impact pin chamber (18) to make compressed air push the impact pin (1) to retract, air ducts communicating with the stretching air duct inlet (9) on the impact pin chamber (18) to discharge residual air in the impact pin chamber (18); characterized in that, on the outer periphery of said centrifugal valve (13) there is a mutually communicated eccentric annular slot (14, 15) and a concentric annular slot (6), and another concentric annular slot (12) spaced apart from the eccentric annular slot (14, 15); wherein a depth portion (14) of the eccentric annular slot (14, 15) is adjacent to the incoming air duct (10*a*) communicated with the compressed air inlet (10), while a shallow portion (15) of the eccentric annular slots (14, 15) is adjacent to the plunger (2).

2. Said storing energy type of impact control mechanism according to claim 1, characterized in that, the limiting device to limit the centrifugal valve (13) to move outward from the centrifugal valve chamber (19) comprises a limiting member formed by a limiting plunger head (16) fixed on the flying hammer (8) with one end sticking into the centrifugal valve chamber (19) and a limiting structure formed by a limiting key-slot (29) located on the centrifugal valve (13), in sliding fit with the plunger head (16) and communicating with another concentric annular slot (12).

3. Said storing energy type of impact control mechanism according to claim 1, characterized in that said air ducts located in the flying hammer (8) communicating the compressed air inlet (10) with the stretching air duct inlet (9) on the impact pin chamber (18) to make compressed air push the impact pin (1) to stretch comprise an incoming air duct (10*a*) communicated with the compressed air inlet (10), a stretching air duct (11) with one end, through the eccentric annular slot (14, 15) on the centrifugal valve (13) being able to communicate with the incoming air duct (10*a*) and a transition air duct (25) with one end communicated with the stretching air duct inlet (9) and another end communicated with the stretching air duct (11); and the air duct communicated with the retracting air duct inlet (5) on the impact pin chamber (18) so as to discharge the residual air in the impact pin chamber (18) comprises a retracting air duct (4) with one end communicated with the retracting air duct inlet (5) and another end communicated with the centrifugal valve chamber (19);

said air duct located in the flying hammer (8) communicating the compressed air inlet (10) with the retracting air duct (5) on the impact pin chamber (18) so as to make compressed air push the impact pin (1) to retract comprises a retracting air duct (4) with one end, through the concentric annular slot (6) and eccentric annular slot (14, 15) on the centrifugal valve (13), being able to communicate with the incoming air duct (10*a*) and another end to communicate with the retracting air duct (5), and the air duct communicated with the stretching air duct inlet (9) on the impact pin chamber (18) to make the residual air in the impact pin chamber (18) discharge comprises a stretching air duct (11) with one end communicated with the stretching air duct inlet (9) and another end, through another concentric annular slot (12) on the centrifugal valve (13), being able to communicate with the centrifugal valve chamber (19).

4. Said storing energy type of impact control mechanism according to claim 2, characterized in that said air ducts located in the flying hammer (8) communicating the compressed air inlet (10) with the stretching air duct inlet (9) on the impact pin chamber (18) to make compressed air push the impact pin (1) to stretch comprise and incoming air duct (10*a*) communicated with compressed air inlet (10), a stretching air duct (11) with one end, through the eccentric annular slot (14, 15) on the centrifugal valve (13) being able to communicated with the incoming air duct (10*a*) and transition air duct (25) with one end communicated with the stretching air duct inlet (9) and another end communicated with the stretching air duct (11); and the air duct communicated with the retracting air duct inlet (5) on the impact pin chamber (18) so as to discharge the residual air in the impact pin chamber (18) comprises a retracting air duct (4) with one end communicated with the retracting air duct inlet (5) and another end communicated with the centrifugal valve chamber (19);

said air duct located in the flying hammer (8) communicating the compressed air inlet (10) with the retracing air duct (5) on the impact pin chamber (18) so as to make compressed air push the impact pin (1) to retract comprises a retracting air duct (4) with one end, through the concentric annular slot (6) and eccentric annular slot (14, 15) on the centrifugal valve (13), being able to communicate with the incoming air duct (10*a*) and another end to communicate with the retracting air duct (5), and the air duct communicated with the stretching air duct inlet (9) on the impact pin chamber (18) to make the residual air in the impact pin chamber (18) discharge comprises a stretching air duct (11) with one end communicated with the stretching air duct inlet (9) and another end through another concentric annular slot (12) on the centrifugal valve (13), being able to communicate with the communicate with the centrifugal valve chamber (19).

* * * * *